United States Patent [19]

Comte

[11] 4,225,833

[45] Sep. 30, 1980

[54] HELICAL CIRCULAR WAVE GUIDE HAVING LOW LOSS AROUND CURVES AND OVER A WIDE FREQUENCY BAND

[75] Inventor: Georges Comte, Lyons, France

[73] Assignee: Les Cables de Lyon, Lyon, France

[21] Appl. No.: 913,166

[22] Filed: Jun. 6, 1978

[30] Foreign Application Priority Data

Jun. 24, 1977 [FR] France ..... 77 19403

[51] Int. Cl.[2] ..... H01P 3/13

[52] U.S. Cl. ..... 333/242; 29/600; 138/113; 138/139; 138/148

[58] Field of Search ..... 29/600; 333/95 R, 95 A, 333/239, 241, 242; 138/113, 129, 139, 148

[56] References Cited

U.S. PATENT DOCUMENTS

| | | | |
|---|---|---|---|
| 3,121,206 | 2/1964 | Mandel | 333/95 R |
| 3,343,250 | 9/1967 | Berto et al. | 138/113 X |
| 3,605,046 | 9/1971 | Miller | 333/242 |
| 4,090,280 | 5/1978 | Ormili et al. | 29/600 X |

*Primary Examiner*—Paul L. Gensler

*Attorney, Agent, or Firm*—Sughrue, Rothwell, Mion, Zinn and Macpeak

[57] ABSTRACT

A helical circular wave guide which reduces loss around curves. It includes contiguous turns of copper wire coated with a thermoplastic material, said helical turns being surrounded by a first tube made of aluminium in contact with the helix and by a second tube made of steel held centered in relation to said first tube by supports made of plastic material.

3 Claims, 3 Drawing Figures

HELICAL CIRCULAR WAVE GUIDE HAVING LOW LOSS AROUND CURVES AND OVER A WIDE FREQUENCY BAND

FIELD OF THE INVENTION

The present invention relates to a helical circular wave guide which has low loss over a wide frequency band when negotiating curves.

BACKGROUND OF THE INVENTION

Helical circular wave guides which transmit the $TE_{01}$ mode constitute a very advantageous telecommunications trunk due to their low loss at decimetric and millimetric wavelengths. However, negotiating curves sets problems for these guides, since the $TE_{01}$ mode then degenerates into another mode, $Tm_{11}$, which does not have the same properties so that the resulting loss greatly increases.

One means of reducing this loss in curves is constituted by helical wave guides which are particularly efficient when the guide includes a conductive screen outside the helix at a relatively short distance from the helix in relation to the wavelength.

One application of this principle had already been embodied by the use of enamelled copper wires wound in a helix on a mandrel and coated with thin layers of glass cloth tape and with a screen formed by wire gauze, metal tapes or metallized paper, all impregnated with polymerized expoide resin intended to harden the structure as a whole after possible reinforcing by other glass cloth or a mechanical protection tube and removal of the forming mandrel.

However, this type of guide had only relatively limited performance:

(a) it was possible to manufacture it only by a semi-continuous method which is slowed down by the time necessary for hardening the resin; and (b) presently known polymerizable resins have a relatively wide dielectric loss angle such that tg $\delta$ is about 1 to $10\times10^{-2}$, so that the curvature losses were not at all negligible, as shown by the formula established by G. COMTE and J. P. TREZEGUET (Cables et Transmissions No. 2, April, 1972, pages 166 to 182).

The application of this formula shows that for a dielectric thickness lying between the internal wall of the guide and the screen, the lower the loss factor $K=\epsilon''/2\epsilon'$ of the dielectric, the less the loss for a curve of radius R and it is seen also that the lower the permittivity $\epsilon_r'$ of the dielectric the wider the guide's favourable frequency bank around curves (the lowest permeability is obtained when $\epsilon_r/\epsilon_o=1$.).

A first improvement had been made to this effect by forming continuously manufactured helical wave guides in accordance with French Pat. No. 1,604,891 of Dec. 31, 1968, invention of B. ORMILI and G. COMTE entitled "A machine for semi-continuous or continuous manufacture of helical circular wave guides" by means of an enamelled copper wire covered with adhesive tape intended to hold the wire and themselves covered with a conductive screen.

However, this realization has limits since it is quite a problem to hold the turns by adhesive tape and also the loss angle of these tapes cannot be very small, because of the type of material which constitutes the tapes (Mylar)(tg $\delta$ about $40\times10^{-4}$) and the type of the adhesive which is generally polar and can have absorption maxima for millimetric waves.

Further, a low loss around curves can be maintained only if the instantaneous radius of curvature of the line does not produce sudden variations as would be the case if the mechanical protection of the guide did not sufficiently attenuate the effects of the stresses which are applied to it in particular during laying and due to the movements of the ground.

The helical circular wave guide remedies these disadvantages. It aims to produce minimal loss around curves (even curves of fairly small radius, e.g. 29m) for the widest possible frequency band, while having a very low cost price due to the continuous method used and to the choice of the materials which constitute it and providing sufficient mechanical protection for preventing sudden variations of the local radius of curvature of the guide.

SUMMARY OF THE INVENTION

The present invention provides a helical circular wave guide formed by a copper wire coated with a low loss thermoplastic material of the polyolefin class, such as polyethylene or polypropylene, wound in a helix with contiguous turns and welded turns to turn, said helix being covered by an aluminium screen tube drawndown on the helix, to a slightly larger diameter than the outer diameter of the helix, wherein the assembly formed by the helix and the screen tube is placed inside a protective steel tube with a greater diameter than that of said screen tube, said screen tube being held centered in relation to said steel tube by centering bushings.

The invention will be better understood on examining the example given hereinbelow with reference to the accompanying drawings.

DESCRIPTION OF THE PREFERRED EMBODIMENT

Figure 1:
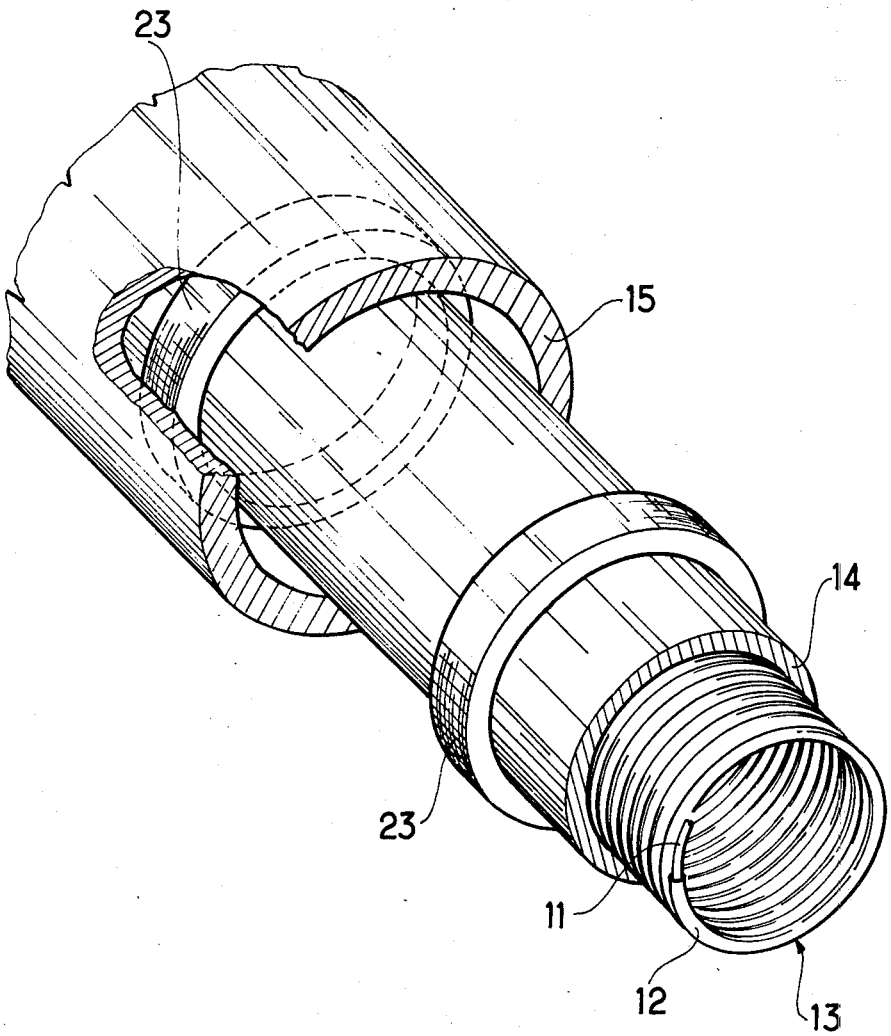
FIG. 1 is a cutaway perspective view of a wave guide forming one embodiment of the invention.

By way of a non-limiting example, a helical guide in accordance with the invention includes (FIG. 1):

(a) a copper or aluminum wire 11 coated with a thermoplastic material 12 (polyethylene, polypropylene, etc.) which has very low loss, whose neighbouring turns are seam welded to one another by the method described in French Pat. No. 2,314,592 of June 12, 1975, "Helical wave guides ", to G. COMTE (equivalent to British Pat. No. 1,499,947 & U.S. Pat. No. 4,071,834). This method effectively maintains turns welded to one another so that the assembly forms only one single-piece tube whose internal wall can be very regular due to the dispositions adopted in the preceding patent; and (b) the helix 13 thus welded is covered by a metal tube 14 made for example of aluminum, which may be extruded or formed by welding a longitudinal strip in accordance with French Pat. No. 2,081,303 of March 31, 1970, "helical wave guides" to G. COMTE.

This tube is then drawn down in a die so as to nearly touch the external wall of the helix while nonetheless leaving, very little play, so as not to squash the helix as this would be liable to modify its internal regularity.

Figure 2:
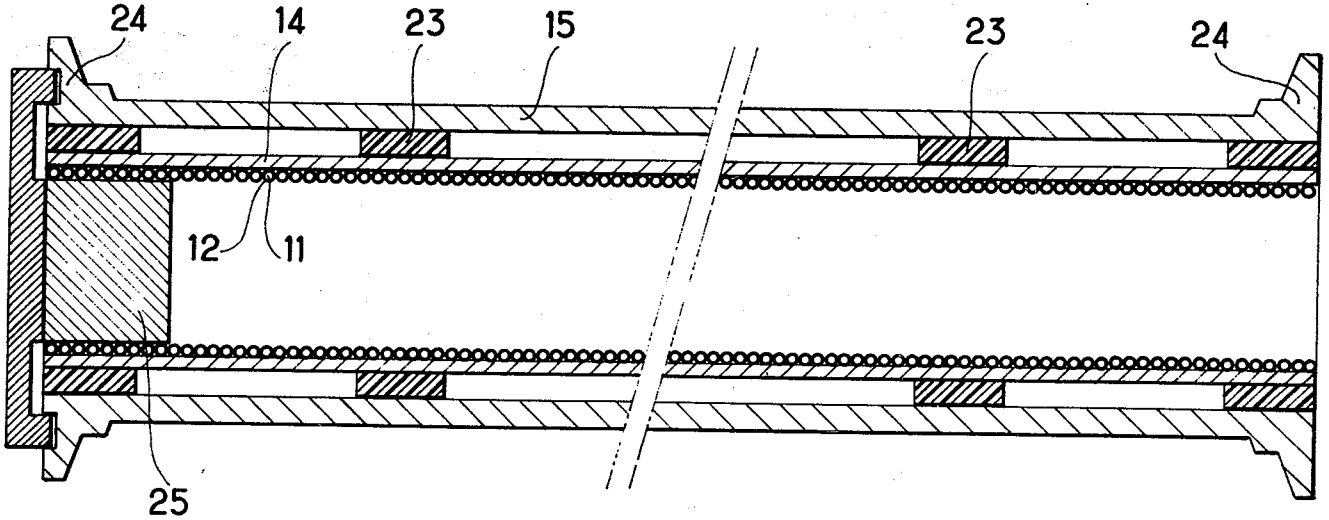
FIG. 2 is a longitudinal cross-section of a section of the wave guide of FIG. 1.

The structure thus formed by the helix covered by the metal tube is then covered by extra protection 15 formed by a second thicker external metal tube. In this disposition, the internal metal tube 14 is held centred in relation to the external protective tube 15 by supports such as spacers or centering bushings 23 formed for example of plastic materials, as shown in FIG. 2. At both ends, the internal metal tube is made integral with the protective tube by gluing at connection flanges such as 24, by the centering bushing 23; a little play is left to allow for positioning the concentricity of the various parts in relation to the axis of the wave guide is provided by an expandible positioning mandrel 25 which is left in place until the glue has hardened, then removed to allow the end surfaces of the guide to be trued.

Due to their rigidity which leads to their being cut into lengths of a few tens of meters for transport, the individual lengths can be connected together for example by removable connections as decribed in French Pat. No. 2,134,176 of Apr. 23, 1971, "A connection device for wave guides and a method of assembling it", to G. DAUJEARD.

By way of a non-limiting example, the wave guide in accordance with the invention is formed with copper wire 0.5 mm in diameter coated with a (radial) thickness of 0.05 to 0.1 mm of polypropylene, $$(\epsilon=2.3\ \epsilon''/\epsilon'=4\times10^{-4} \text{ at } 35 \text{ GHz})$$

welded in contiguous turns and covered with an aluminium tube 1.5 mm thick, extruded and then drawn-down until it is tangential to the external surface of the helix.

External protection is provided by a steel tube 2 to a 3 mm thick and with an outside diameter close to 70 mm for a wave guide with an inside diameter of 50 mm. The spacers placed between the two tubes are formed preferably of a foam material capable of being squashed when the aluminium tube is placed in the steel tube and then to resume its former shape to center the two concentric structures. In this way, it is certain that even if the external steel tube is subjected to great transversal stresses, these stresses are only partially transmitted to the aluminium tube and that this tube is bent regularly without any critical points as could be the case with different protection.

It is therefore possible to calculate the loss around a curve without taking into account critical bends due to any abnormal deformation of the guide and thus to obtain minimum loss for a given curve in accordance with the results of the forecasts.

Figure 3:
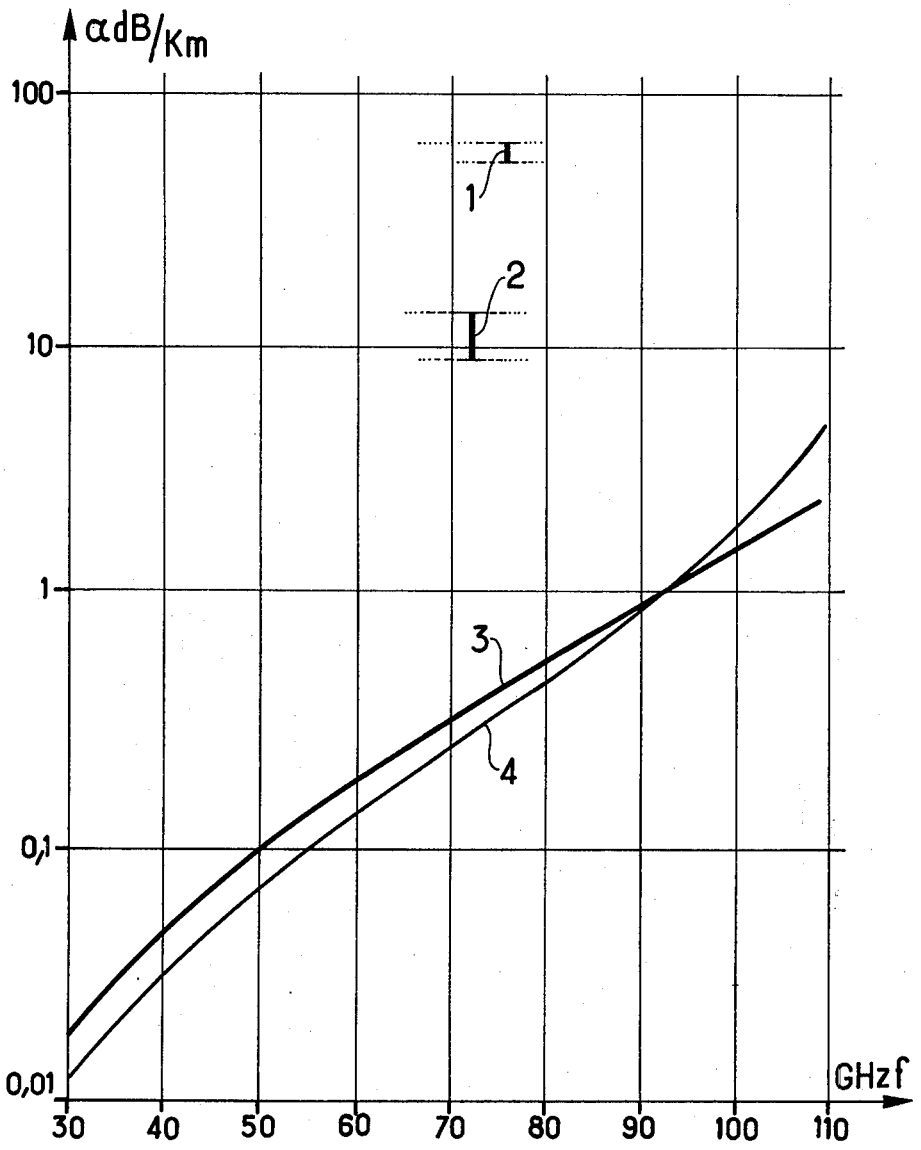
FIG. 3 is a graph of loss as a function of frequency for prior art wave guides and for wave guides produced in accordance with the invention.

By way of illustration, FIG. 3 shows the loss curves of various types of wave guides in accordance with prior art: 1 (semi-continuous wave guide coated with epoxy resin and without an aluminium tube); 2 (guide with adhesive tape and an aluminium tube) as well as guides formed in accordance with the invention, graphs 3 and 4 corresponding to wave guides which have helical conductors coated with polypropylene covered with an aluminium tube and with a steel tube, curve 3 relating to wave guides obtained with wires 0.6 mm in diameter, curve 4 relating to wave guide obtained with wires 0.75 mm in diameter.

The extra loss due to bending is given in dB/km for a radius of curvature of 20 m as a function of frequency from 30 to 110 GHz.

It is seen that there is a proportion of at least one to ten between the losses of adhesive tape wave guides and those of welded wave guides in accordance with the invention, the adhesive tape wave guides themselves being 5 to 10 times better than the semi-continuous wave guides which use epoxy resins.

What is claimed is:

1. A helical circular wave guide formed by a copper wire coated with a low loss polyolefin thermoplastic material wound in a helix with contiguous turns and welded turn to turn, the improvement comprising: said helix being covered by a continuous aluminum screen tube drawn-down on the helix, said aluminum screen tube being of a slightly larger diameter than the outer diameter of the helix, the assembly formed by the helix and the screen tube being placed inside a protective steel tube, said protective steel tube being of a larger diameter than that of said continuous aluminum screen tube, and defining a space between the steel tube and the aluminum tube, longitudinally spaced bushings between said steel tube and said aluminum screen tube for holding said aluminum screen tube centered in relation to said steel tube and and spaced therefrom to maintain the space between the steel tube and the aluminum tube empty absent the spaced bushings, and said aluminum screen tube being integral with the protective steel tube at respective ends of said tube by end bushings glued between said aluminum screen tube and said protective steel tube.

2. A guide according to claim 1, wherein said centering bushings are made of a foam plastic material.

3. A guide according to claim 1, wherein both ends of said steel tube are provided with connecting fixing flanges to allow inter-connection of adjacent lengths of said wave guide.

* * * * *